United States Patent [19]

Uhlig

[11] 4,119,235

[45] Oct. 10, 1978

[54] PLASTIC DRUM WITH METAL HANDLING RING

[75] Inventor: Albert R. Uhlig, Toledo, Ohio

[73] Assignee: Owens-Illinois, Inc., Toledo, Ohio

[21] Appl. No.: 800,501

[22] Filed: May 25, 1977

[51] Int. Cl.[2] ..... B65D 7/42

[52] U.S. Cl. ..... 220/71; 220/5 R; 220/DIG. 1

[58] Field of Search ..... 29/511; 220/5 R, 71, 220/73, 85 K, 85 R, DIG. 1

[56] References Cited

U.S. PATENT DOCUMENTS

| | | | |
|---|---|---|---|
| 3,166,777 | 1/1965 | Frantz | 220/85 K |
| 3,840,141 | 10/1974 | Allom et al. | 220/DIG. 1 |
| 4,022,345 | 5/1977 | Butz | 220/71 |
| 4,024,979 | 5/1977 | Craig et al. | 220/85 K |

*Primary Examiner*—Leon Gilden

*Attorney, Agent, or Firm*—Charles S. Lynch; E. J. Holler

[57] ABSTRACT

Disclosed is a method of making a plastic drum having a radially extending projection near its top to which is crimped a circumferential metal carrier ring adapted to be grasped by conventional metal drum chime handling devices; and the resulting product.

1 Claim, 6 Drawing Figures

PLASTIC DRUM WITH METAL HANDLING RING

Figure 1:
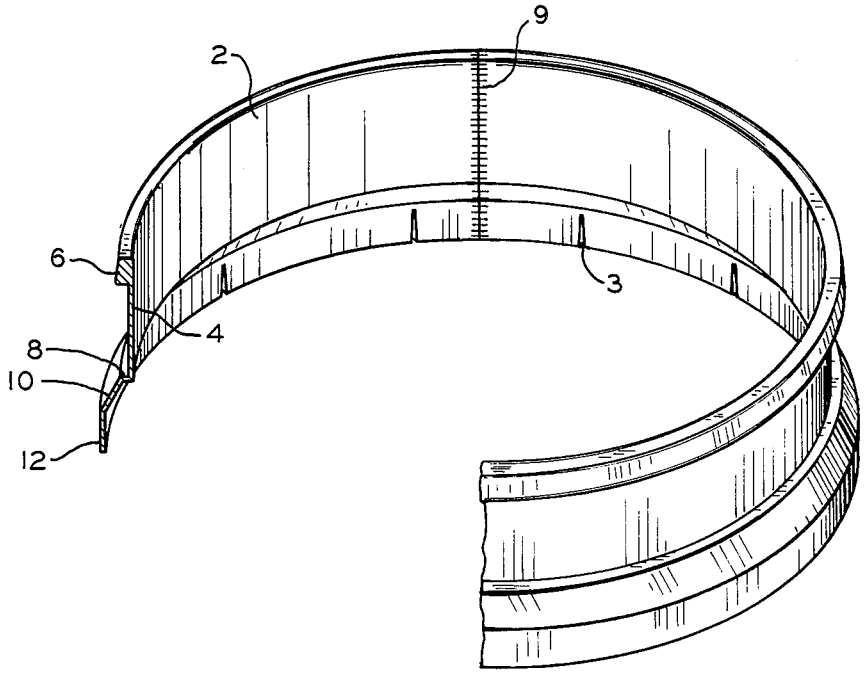

This invention relates to a relatively inexpensively made combination of plastic drum with a crimped on metal carrier ring adapted to be grasped by metal drum chime handling devices, and to a process for making same.

Because of the long time usage of steel drums for handling of materials in bulk, standard equipment has been developed to handle such drums by gripping the chime thereof in order that the drums may be transported and moved. That type of standard equipment is generally recognized, and referred to in the art, as steel drum chime-handling devices or, simply, chime-handling devices. One type of chime-handling device which has wide utility is referred to in the art as a parrot-beak device or, occasionally, as a cherry picker and one such device is sold by the Little Giant Company under the designation Grip-O-Matic. This type of device includes two opposed pivotal, or movable, jaws or beaks which, when brought into contact with a chime on a drum are adapted to open so as to allow them to be positioned with the chime between them and, upon lifting of the drum, the chime is lockingly gripped between the jaws or beaks, allowing for movement and transportation. Other chime-handling devices, such as those referred to as a chime-grabber, and hand truck, likewise include a beak, or jaws, or hooks, to exert a localized force on the chime which allows for the drum to be lifted and then appropriately moved.

More recently, plastic drums have been made available for much the same service as steel drums, but unfortunately these drums have not yet attained their full potential. It will be appreciated that such drums offer many highly desirable characteristics. Some of these desirable characteristics include, for example, low price, low shipping costs, a wide scope of product application without the need for liners, ability to handle materials corrosive to metals, high resistance to the detrimental influence of weather, low unit weight, rust resistance, dent resistance, and in general they are highly aesthetically pleasing. A significant deterrent to the wider acceptance and usage of such plastic drums, such as one-piece, blow mold plastic drums, has been that conventional steel drum chime-handling devices cannot conveniently and interchangeably be employed with plastic drums and steel drums for movement and expeditious handling of both.

It is an object of the invention to provide a plastic drum with an economically made metal carrier ring crimped firmly onto an annular projection of said drum, wherein the ring is adapted for engagement by steel drum chime handling devices.

It is a further object of the invention to provide a method for making such a drum-carrier ring assembly.

Other objects, features and aspects, as well as advantages, of the present invention will become apparent from a study of the following description and drawings.

In one aspect of the invention there is provided in combination, a plastic drum and a carrier ring attached to the top portion of said drum, comprising (1) a plastic drum having a generally vertical sidewall and having a substantially circular cross-section in a plane normal to its vertical axis, wherein said sidewall near its top has an outwardly radially extending annular projection having a substantially horizontal circumferential annular downwardly facing first ledge adjacent said sidewall and having a substantially horizontal circumferential annular upwardly facing second ledge adjacent said sidewall and (2) a metal carrier ring having a circular cross-section in a plane normal to its vertical axis and having an upper substantially cylindrical portion (i) having an open top which is at the same or a higher level than the top of said drum, (ii) having a radially outwardly thickened top portion adapted to be grasped by steel drum chime handling devices and (iii) terminating at its base in an outwardly radially extending, substantially horizontal annular ring portion seated on said second ledge, which annular ring portion terminates in a downwardly and outwardly flaring frusto-conical section that in turn terminates in an inwardly crimped circumferential skirt portion that tightly grips said first ledge from below and exerts an upward force thereon.

In another aspect of the invention there is provided a method for making a plastic drum having a metal carrier ring attached to the top portion thereof, comprising (1) forming a plastic drum having a generally vertical sidewall and having a substantially circular cross-section in a plane normal to its vertical axis, wherein said sidewall near its top has an outwardly radially extending annular projection having a substantially horizontal circumferential annular downwardly facing first ledge adjacent said sidewall and having a substantially horizontal circumferential annular upwardly facing second ledge adjacent said sidewall, (2) providing a metal carrier ring having a circular cross-section in a plane normal to its vertical axis and having an upper substantially cylindrical portion (i) having a radially outwardly thickened top portion and (ii) terminating at its base in an outwardly radially extending, substantially horizontal annular ring portion adapted to fit over and rest on said second ledge, which annular ring portion terminates in a downwardly and outwardly flaring frusto-conical section that in turn terminates in downwardly extending circumferential skirt portion that (i) meets said frusto-conical portion at an interior angle of less than 180° and (ii) is of a length such that it extends below said first ledge when said angular ring portion is resting on said second ledge, (3) placing said carrier ring in a position to rest on said second ledge and (4) mechanically holding said ring in the position set forth in (3) while circumferentially applying mechanical force upwardly and inwardly to said skirt to crimp said skirt inwardly and upwardly so that the bottom end of said skirt is crimped in a manner such that it tightly grips said first ledge of said annular radial projection of said drum.

While it is not a part of the invention, suitable plastics for making the plastic drums include high density (over 0.945 gms/cc) polyethylene, especially high molecular weight HDPE having a molecular weight of about 150,000 to 250,000. The metal carrier ring is usually made of steel because of its strength, hardness and durability.

Figure 2:
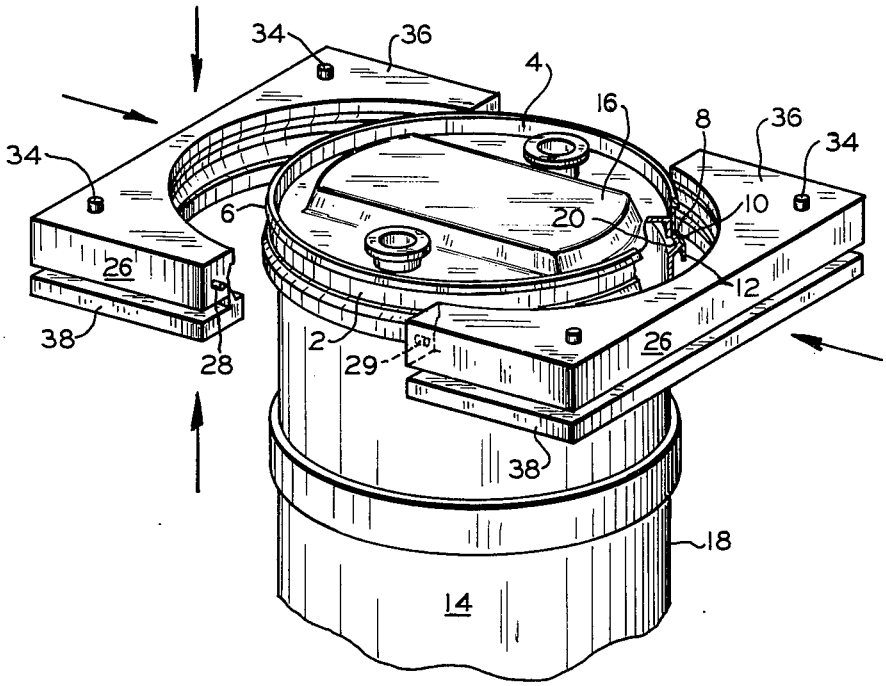
Figure 3:
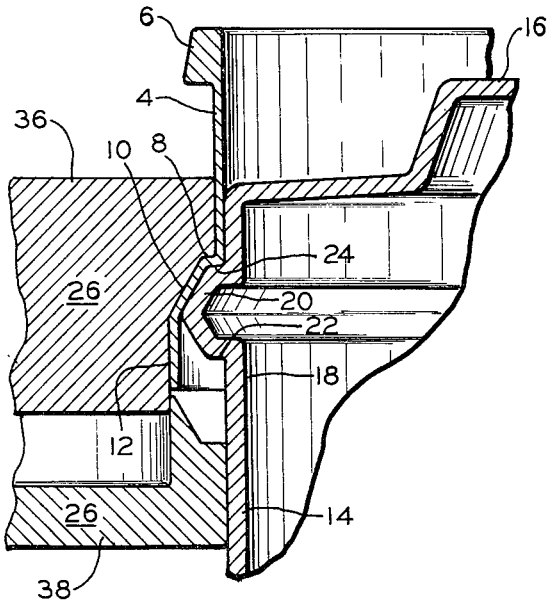
Figure 4:
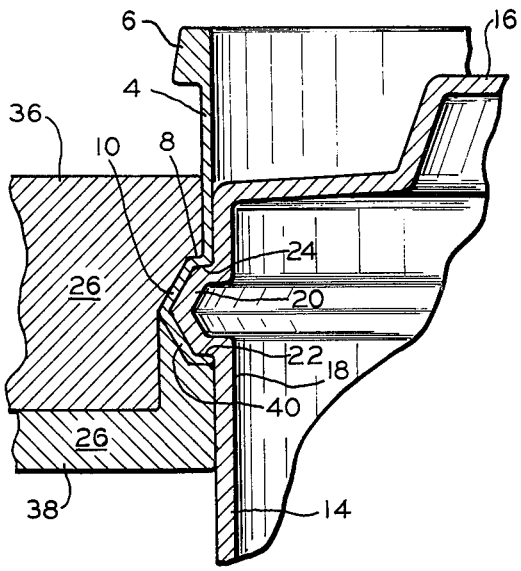
Figure 5:
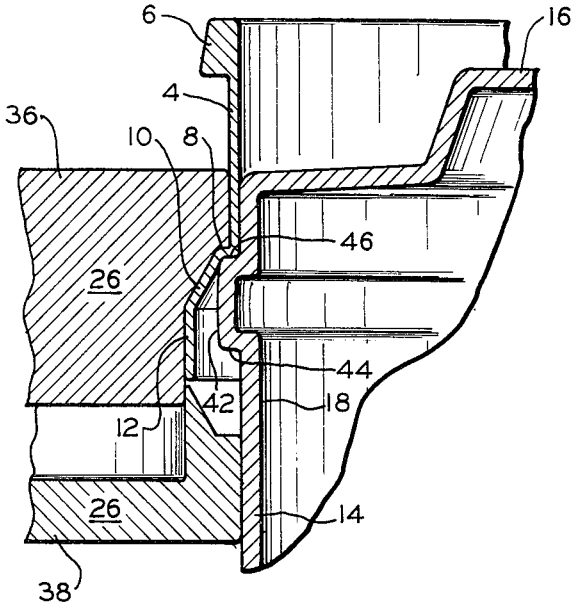
Figure 6:
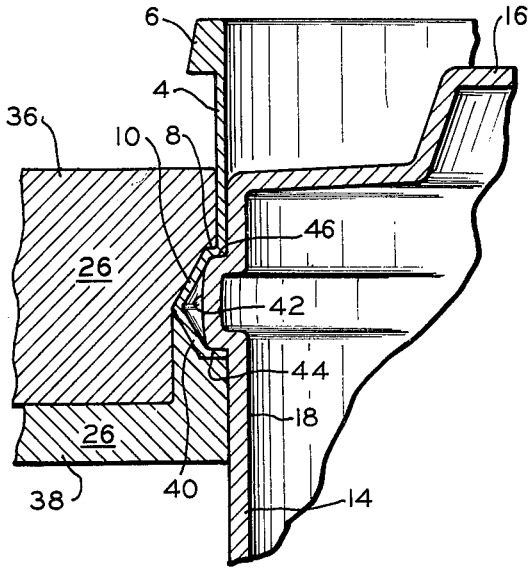

In FIG. 1 there is shown a perspective view of three-fourths of a metal carrier ring used in the method of the invention. FIG. 2 is a perspective view of the top portion of a plastic drum with a metal ring of FIG. 1 in place before being crimped on, shown in more detail in FIG. 3. FIGS. 3 and 4 are enlarged partial cross-sectional views of the drum, metal ring carrier and the split ring shaping members shown in FIG. 2, but shown in FIGS. 3 and 4 in later stages of the process of the invention. FIGS. 5 and 6 are the same as FIGS. 3 and 4, respectively, except that the annular projection on the drum is of a somewhat different shape.

In FIGS. 1, 2 and 3 the metal carrier ring 2 has a circular cross-section in any plane normal to its vertical axis and has an upper substantially cylindrical portion 4 having a radially outwardly thickened top portion 6. Cylindrical portion 4 terminates at its base in an outwardly radially extending, substantially horizontal annular ring portion 8, which annular ring portion 8 terminates in a downwardly and outwardly flaring frusto-conical section 10 that in turn terminates in downwardly extending circumferential skirt portion 12 that meets said frusto-conical portion at an interior angle of less than 180°. Ring 2 can optionally have three or more slots 3 cut from its bottom edge at least part way to where said skirt meets said frusto-conical section 10 to make the crimping step more easily accomplished. Ring 2 can be made by extrusion of the shape shown in the profile of FIG. 1, followed by joining ends to form the final circumferential shape, as by welding at 9.

In FIGS. 2, 3 and 4 plastic drum 14 has a top end 16 and a bottom end (not shown) and circumferential sidewall 18 joining said top and bottom ends. Near said top end, but below it, sidewall 18 has an outwardly radially extending annular projection 20 which has a substantially horizontal circumferential annular downwardly facing first ledge 22 adjacent said sidewall 18 and a substantially horizontal circumferential annular upwardly facing second ledge 24 adjacent said sidewall 18.

In FIGS. 2, 3 and 4 split ring assembly halves 26 have locating pins 28 on both front and back (not shown) and matching bores 29 on the other halves. Spring loaded die pins 34 provide guidance for the upper and lower halves of assembly 26. The upper plate halves 36 of ring assembly 26 are contoured to fit carrier ring 2. The lower plate halves 38 of each ring assembly 26 are contoured so that, when moved upwardly into closed position, skirt 12 will be crimped so that it assumes the shape indicated at 40 in FIG. 4.

In operation ring 4 is placed on shoulder or ledge 24 and split ring assembly halves 26 are moved into closed position around the carrier ring 2 by mechanical or pneumatic actuators (not shown), until in the position of FIG. 3, with pins 28 seated in bores 29. Then plates 36 and plates 38 are clamped together by actuating means not shown into the position of FIG. 4. During this operation skirt 12 is crimped upwardly and inwardly to assume the shape of FIG. 4 shown at 40. In the closed position of assembly 26 shown in FIG. 4 the skirt 12 when it assumes the shape of 40 has been moved upwardly enough to tightly grip annular projection 20 at ledge 22. The motive force urging plates 36 and 38 together is removed and the springs associated with die pins 34 separate plates 36 and 38 and the split ring assembly halves 26 are opened to the position of FIG. 2, ready for the next drum.

The assembled drum-carrier ring combination is relatively cheaply made and the thickened portion or projection 6 is adapted to be grasped by steel drum chime-handling devices.

FIGS. 5 and 6 illustrate another embodiment of the invention wherein annular projection 42 corresponds to annular projection 20 of FIGS. 3 and 4, and ledges 44 and 46 are like ledges 22 and 24, respectively, of FIGS. 3 and 4. Otherwise, this embodiment is the same as the described embodiment of FIGS. 1–4.

As will be evident to those skilled in the art, various modifications of this invention can be made or followed in the light of the foregoing disclosure and discussion without departing from the spirit and scope of the disclosure or from the scope of the claims.

I claim:

1. In combination, a plastic drum and a carrier ring attached to the top portion of said drum, comprising (1) a plastic drum having a generally vertical sidewall and having a substantially circular cross-section in a plane normal to its vertical axis, wherein said sidewall near its top has an outwardly radially extending annular projection having a substantially horizontal circumferential annular downwardly facing first ledge adjacent said sidewall and having a substantially horizontal circumferential annular upwardly facing second ledge adjacent said sidewall and (2) a metal carrier ring having a circular cross-section in a plane normal to its vertical axis and having an upper substantially cylindrical portion (i) having an open top which is at the same or a higher lever than the top of said drum, (ii) having a radially outwardly thickened top portion adapted to be grasped by steel drum chime handling devices and (iii) terminating at its base in an outwardly radially extending, substantially horizontal annular ring portion seated on said second ledge, which annular ring portion terminates in a downwardly and outwardly flaring frusto-conical section that in turn terminates in an inwardly crimped circumferential skirt portion that tightly grips said first ledge from below and exerts an upward force thereon.

* * * * *